US008569660B2

(12) United States Patent
Baek et al.

(10) Patent No.: US 8,569,660 B2
(45) Date of Patent: Oct. 29, 2013

(54) COOKING APPLIANCE AND METHOD OF CONTROLLING THE SAME

(75) Inventors: Chae Hyun Baek, Seoul (KR); Jeong Ho Lee, Seoul (KR); Yong Soo Lee, Seoul (KR); Seung Chan Lee, Seoul (KR); Yang Kyeong Kim, Seoul (KR); Seung Jo Baek, Seoul (KR)

(73) Assignee: LG Electronics Inc., Seoul (KR)

( * ) Notice: Subject to any disclaimer, the term of this patent is extended or adjusted under 35 U.S.C. 154(b) by 346 days.

(21) Appl. No.: 12/752,948

(22) Filed: Apr. 1, 2010

(65) Prior Publication Data

US 2010/0264126 A1 Oct. 21, 2010

(30) Foreign Application Priority Data

Apr. 20, 2009 (KR) ..... 10-2009-0034009

(51) Int. Cl.
*A21B 1/22* (2006.01)

(52) U.S. Cl.
USPC ..... 219/393; 219/414

(58) Field of Classification Search
USPC ..... 219/402, 408, 476, 477, 479
See application file for complete search history.

(56) References Cited

U.S. PATENT DOCUMENTS

| | | | | |
|---|---|---|---|---|
| 6,486,453 | B1 * | 11/2002 | Bales et al. | 219/702 |
| 6,511,931 | B1 | 1/2003 | Baldwin | |
| 6,730,881 | B1 * | 5/2004 | Arntz et al. | 219/400 |
| 2002/0096510 | A1 | 7/2002 | Metcalfe et al. | |
| 2003/0015514 | A1 | 1/2003 | Choat et al. | |
| 2003/0064874 | A1 | 4/2003 | Eckmann et al. | |
| 2003/0187118 | A1 | 10/2003 | Aronica et al. | |
| 2004/0025910 | A1 * | 2/2004 | Kanzaki et al. | 134/95.1 |
| 2004/0200828 | A1 * | 10/2004 | Becker et al. | 219/506 |
| 2005/0014625 | A1 | 1/2005 | Espargilliere et al. | |
| 2005/0252907 | A1 * | 11/2005 | Levy et al. | 219/497 |

FOREIGN PATENT DOCUMENTS

| | | | |
|---|---|---|---|
| CA | 2446494 | | 10/2003 |
| EP | 1388713 | A2 | 2/2004 |
| EP | 1557612 | A1 | 7/2005 |
| JP | 2006-112746 | | 4/2006 |
| KR | 10-2008-0032708 | | 4/2008 |
| KR | 10-2008-0032708 | A | 4/2008 |

* cited by examiner

*Primary Examiner* — Cheung Lee
(74) *Attorney, Agent, or Firm* — McKenna Long & Aldridge LLP

(57) ABSTRACT

A cooking appliance includes a heat source; an input unit configured to input a plurality of operational modes of the heat source for cleaning a cavity; and a control unit configured to operate the heat source in accordance with a mode input through the input unit, wherein the input unit comprises a selection unit configured to select a specific mode of the plurality of operational modes.

10 Claims, 12 Drawing Sheets

COOKING APPLIANCE AND METHOD OF CONTROLLING THE SAME

The present application claims priority under 35 U.S.C. 119 and 35 U.S.C. 365 to Korean Patent Application No. 10-2009-0034009, filed on Apr. 20, 2009, which is hereby incorporated by reference herein in its entirety.

BACKGROUND

The present disclosure relates to a cooking appliance and a method of controlling the cooking appliance.

Generally, a cooking appliance is a device for cooking or heating food using a heating source.

An example of a cooking appliance could include a cavity defining a cooking chamber in which food is cooked, a heat source to heat the contents of any food in the cooking chamber, a door that is opened and closed so that a user can load and unload the food into and out of the cooking chamber.

After cooking of the food loaded in the cooking chamber is finished, leftover food is adhered to an inner wall of the cavity and thus cleaning of the inside of the cavity is required.

SUMMARY

Embodiments provide a cooking appliance and a method of controlling the cooking appliance.

In one embodiment, a cooking appliance may include a heat source, an input unit configured to input a plurality of operational modes of the heat source, wherein at least one of the plurality of operational modes is a cleaning mode for cleaning a cavity of the cooking appliance, and a control unit configured to operate the heat source in accordance with an operational mode input through the input unit, wherein the input unit comprises a selection unit configured to permit a user to select a specific mode of the plurality of operational modes.

In another embodiment the cooking appliance may include a cavity configured to define a cooking chamber, a heat source configured to generate heat to clean the cavity, an input unit configured to select between at least a first operational mode of the heat source to clean the cavity and second operational mode of the heat source to cook food in the cavity, and a control unit configured to control operation of the heat source in accordance with the first or second operational mode, wherein a porcelain enamel coating layer comprising a phosphate-based ingredient is provided on an inner surface of the cavity.

In one embodiment, a control method of the cooking appliance may include receiving an identifier of one of a plurality of cleaning modes to clean a cavity of the cooking appliance, receiving a start signal, starting an operation of a heat source in accordance with predefined parameters associated with the received cleaning mode, and stopping the operation of the heat source when an operational time of the heat source reaches a predefined operation stop time according to the received cleaning mode.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following description of the preferred embodiments, reference is made to the accompanying drawings that form a part hereof, and in which are shown, by way of illustration, specific preferred embodiments in which the invention may be practiced. Theses embodiments are described in sufficient detail to enable those skilled in the art to practice the invention, and it is understood that other embodiments may be utilized and that logical structure, chemical, electrical, and chemical changes may be made without departing from the sprit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
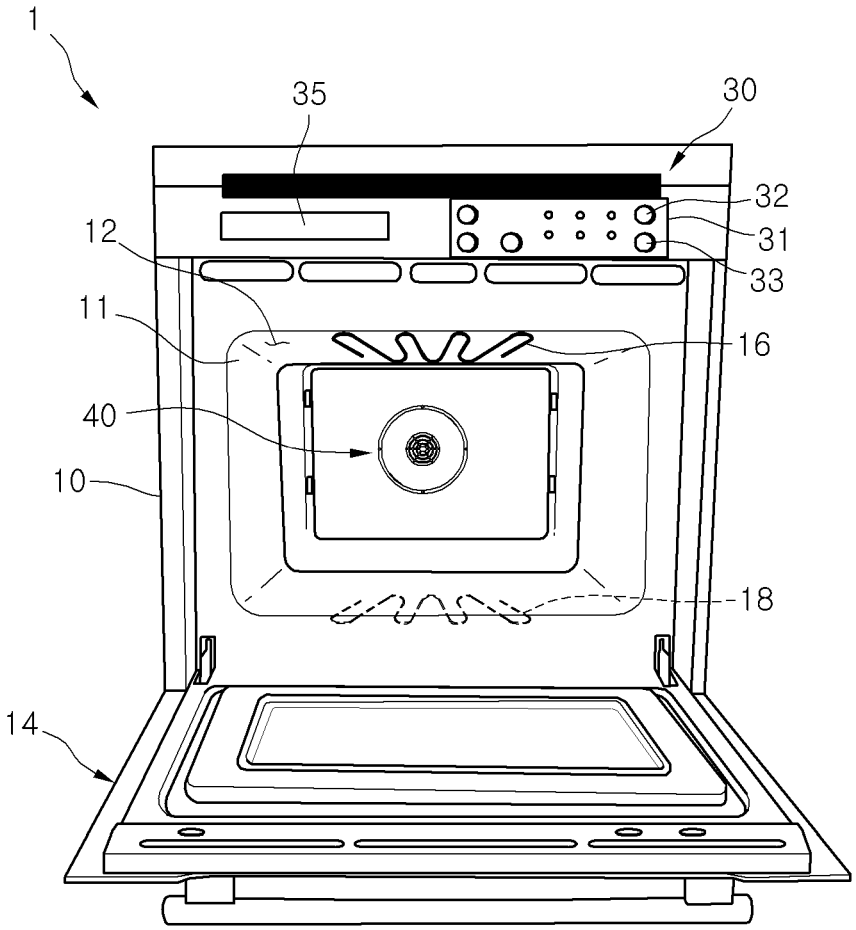
FIG. 1 is a perspective view of a cooking appliance according to a first embodiment of the invention.
Figure 2:
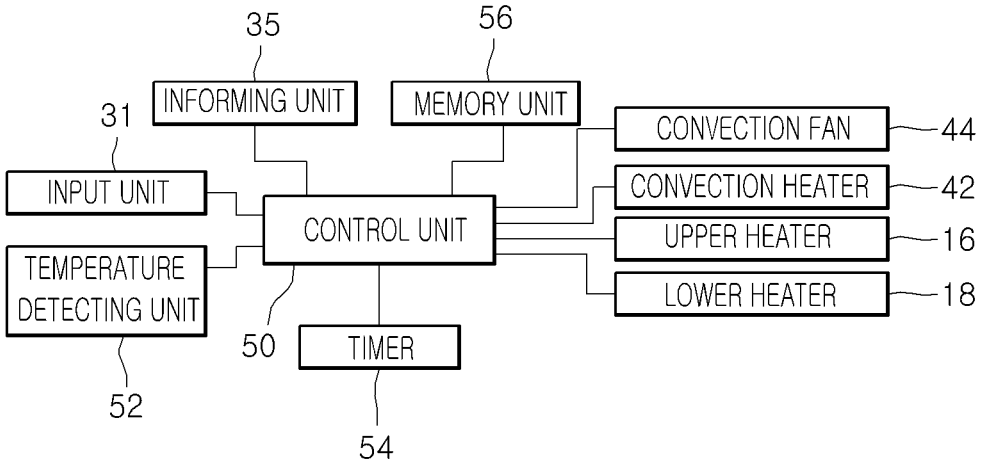
FIG. 2 is a block diagram of the cooking appliance of FIG. 1.

FIG. 1 is a perspective view of a cooking appliance according to a first embodiment of the invention, and FIG. 2 is a block diagram of the cooking appliance of FIG. 1. FIG. 1 shows a state of a cooking appliance 1 where a door 14 is opened, all in accordance with an embodiment of the invention.

Referring to FIGS. 1 and 2, a cooking appliance 1 of an embodiment includes an outer case 10 defining an appearance of the cooking appliance, a cavity 11 provided in the outer case 10, a door 14 for opening and closing the cavity 11. A cooking chamber may be defined by the five walls of the cavity 11 and a surface of the door 14, which when closed effectively forms a sixth wall of the cavity 11. A porcelain enamel coating layer 12 may be provided on an inside surface of the cooking chamber. Also included in the cooking appliance may be a heat source 16, 18 for heating food loaded in the cavity 11, and a control panel 30 provided on a side of the outer case 10 and enabling a user to manipulate the cooking appliance.

The cooking appliance 1 further includes a temperature detecting unit 52 (FIG. 2) for detecting an internal temperature of the cavity 11, a control unit 50 (FIG. 2) for controlling overall operation of the cooking appliance 1, and a memory unit 56 (FIG. 2) for storing operational conditions of the cooking appliance 1 as well as instructions which, when executed by the control unit 50, cause the cooking appliance to perform the steps of the method of the invention.

In more detail, an upper heater 16 may be provided at an upper side of the cavity 11 and a lower heater 18 may be provided at a lower side of the cavity 11. A convection assembly 40 for discharging hot air into the cavity 11 may be provided at a rear side of the cavity 11.

The upper and lower heaters 16 and 18 may be provided at an inside or outside of the cavity 11.

In the illustrated embodiment, the heat source includes a plurality of heaters 16, 18. However, the heat source may further, or alternately, include a magnetron or an ultrasonic unit. That is, the heat source is not limited to a specific type of device or number of devices.

As illustrated in FIG. 2, the convection assembly 40 may include a convection heater 42 and a convection fan 44 for directing the heat generated by the convection heater 42 to the cavity 11.

The control panel 30 may include an input unit 31 for inputting an operational condition and an informing unit 35 to audibly and/or visually inform a user of an operational state of the cooking appliance 1.

The input unit 31 may include a selection unit 32 for selecting an operational mode of the heat source 16, 18 to clean the inside of the cavity 11, or to cook food in the cavity 11, and a start button 33 for starting the selected mode.

An operational mode (hereinafter, referred to as the "cleaning mode") of the heating source for cleaning the cavity 11 may comprise multiple modes, such as first, second, and third cleaning modes. The cleaning modes may be classified according to a level of pollution of the cavity 11.

The level of the pollution of the cavity 11 may be determined by the user. That is, a specific cleaning mode may be selected in accordance with the determination of the user. By way of example, the first mode made be useful for cleaning the cavity 11 when the pollution level of the cavity 11 is minimal. The second mode may be useful for cleaning when the pollution level of the cavity 11 is moderate. The third mode may be useful for cleaning when the pollution level of the cavity 11 is substantial.

Further, a selection of a cleaning mode may be determined in accordance with the number of times a user presses the selection unit 32. That is, when the user presses the selection unit 32 one time, the first mode may be selected. When the user presses the selection unit 32 one additional time (a total of two presses), the second mode may be selected. In addition, when the user presses the selection unit 32 still one more time (a total of three presses), the third mode may be selected.

Although the cleaning mode is selected in accordance with the number of times of pressing of the selection unit 32 in the exemplary embodiments described herein, the present invention is not limited to this. For example, a plurality of selection buttons corresponding to the respective cleaning modes may be provided. That is, when there are three cleaning modes, three selection buttons may be provided. Alternatively, the cleaning mode may be selected in accordance with an amount of time a user holds the selection unit 32 in a pressed state. For example, when the user presses and holds the selection unit 32 for 1 second, the first mode is selected. When the user presses and holds the selection unit 32 for 2 seconds, the second mode is selected. When the user presses and holds the selection unit 32 for 3 seconds, the third mode is selected. Other structures, devices, or methods of selecting the cleaning mode are acceptable.

In one embodiment, when the user selects a wrong cleaning mode, the user may remove the pressing force and subsequently select a corrected cleaning mode as, for example, described above.

The informing unit 35 may inform a user, for example, that a time for cleaning the cavity 11 has arrived (after completion of a given cleaning mode), or that a certain amount of time remains before a given cleaning mode requires user action. The information from the informing unit 35 may be visual or acoustic information. For example, the informing unit 35 may be a display unit, a light emitting diode, a speaker, and/or a vibration device. The informing unit 35 is not specifically limited to the embodiments described herein.

The memory unit 56 may store instructions that, when executed by the control unit 50, cause the apparatus 1 to perform the steps of the method of the invention. The memory unit 56 may also store operational conditions and timings of the heat source for the respective cleaning modes. For example, cleaning timings may be 5 minutes in the first mode, 20 minutes in the second mode, and 30 minutes in the third mode. These timing values may be stored in the memory unit 56. However, timing values are not limited to the values described herein.

Meanwhile, a porcelain enamel coating layer 12 may be formed on an inner surface of the cavity 11. The porcelain enamel coating layer 12 may contain a phosphate-based ingredient such as phosphorus pentoxide ($P_2O_5$). The phosphate-based ingredient including the phosphorus pentoxide enhances corrosion resistance, rust resistance, and resistance to oxidation at high temperature, thereby making it easy to remove polluting materials that are adhered to the porcelain enamel coating layer 12 of the cavity 11 during the cooking process. For example, the enamel coating layer 12 may contain phosphate-based ingredient, such as phosphorus pentoxide, of 30% or less, preferably, phosphorus pentoxide of 20% or less.

The following will describe a control method of the cooking appliance 1.

Figure 3:
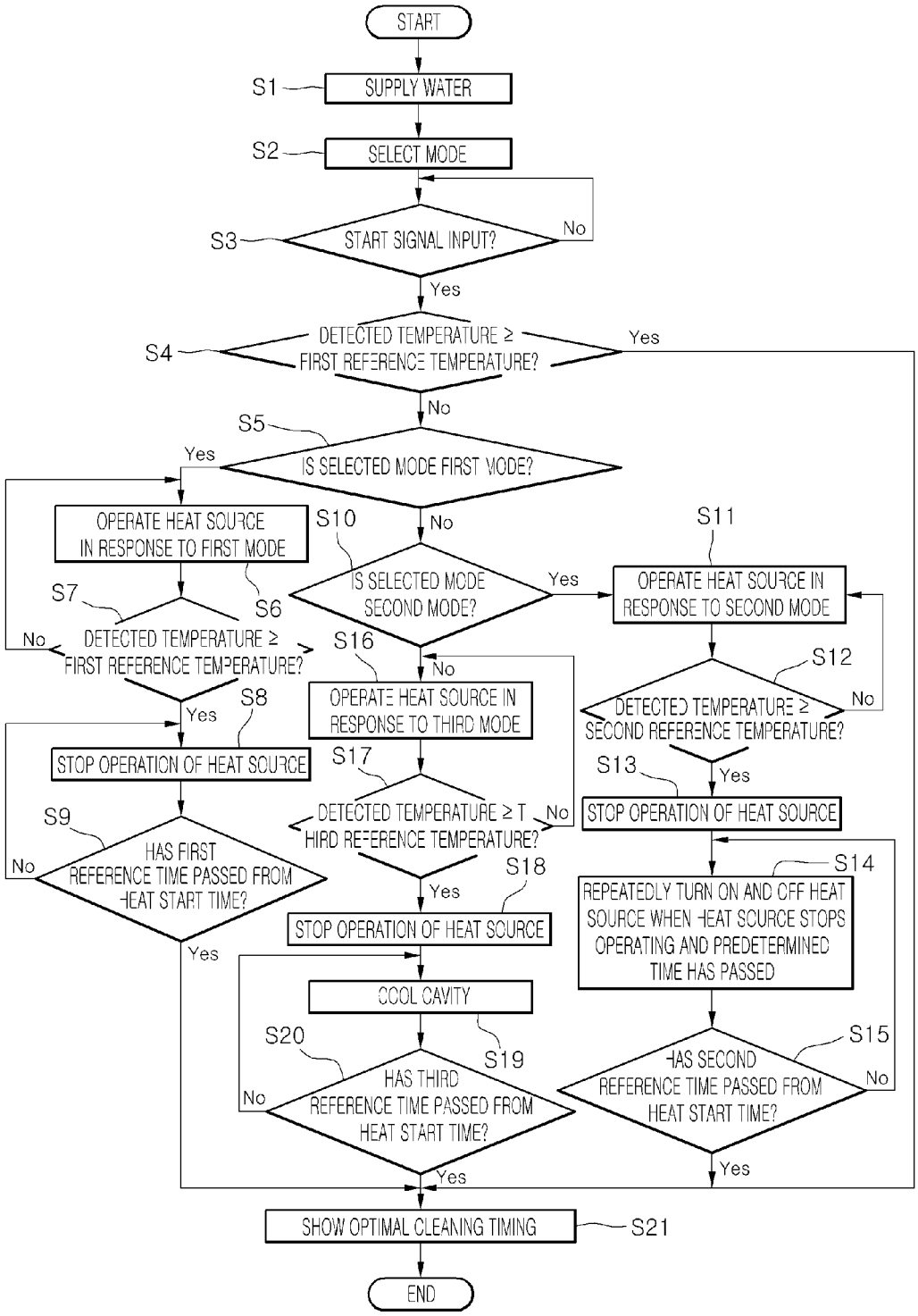
FIG. 3 is a flowchart illustrating a control method of a cooking appliance according to a first embodiment of the invention.
Figure 4:
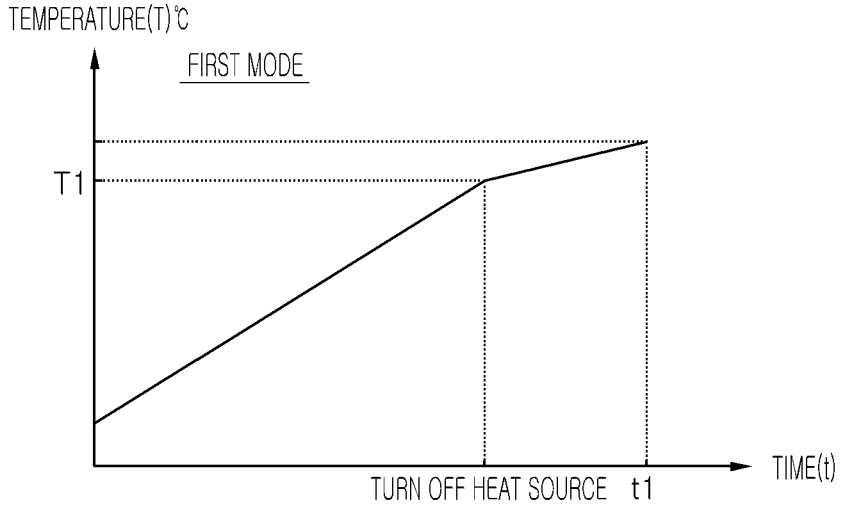
FIG. 4 is a graph illustrating a temperature variation over time in a first mode, according to an embodiment of the invention.
Figure 5:
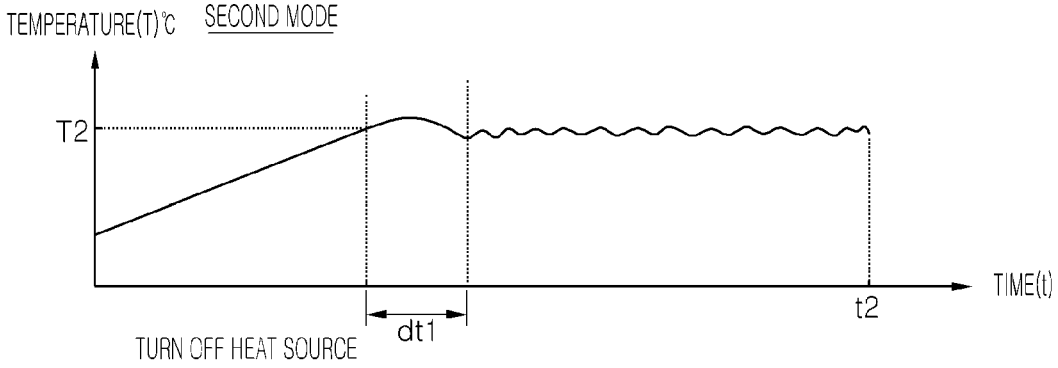
FIG. 5 is a graph illustrating a temperature variation over time in a second mode, according to an embodiment of the invention.
Figure 6:
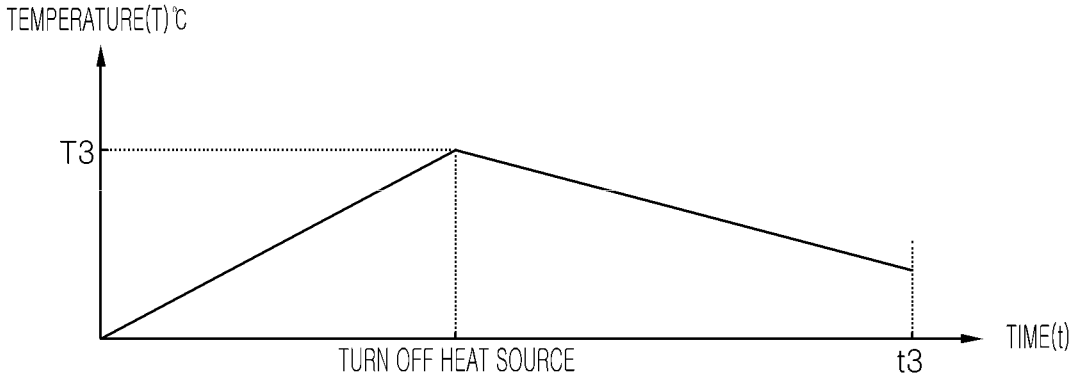
FIG. 6 is a graph illustrating a temperature variation over time in a third mode, according to an embodiment of the invention.

FIG. 3 is a flowchart illustrating a control method of a cooking appliance according to a first embodiment of the invention. FIG. 4 is a graph illustrating a temperature variation over time in a first mode, according to an embodiment of the invention. FIG. 5 is a graph illustrating a temperature variation over time in a second mode, according to an embodiment of the invention. FIG. 6 is a graph illustrating a temperature variation over time in a third mode, according to an embodiment of the invention.

Referring to FIGS. 3 to 6, water for cleaning is supplied into the cavity by a water supplying unit (S1). For example, a user may spray water onto the porcelain enamel coating layer 12 of the cooking chamber using a sprayer, a user may pour water onto a bottom surface of the cavity, or a user may generally sprinkle water onto the porcelain enamel coating layer 12 of the cooking chamber.

Further, a user may select an operation mode of the heat source for cleaning by use of the selection unit 32 (S2). In this embodiment, the cleaning mode is distinct from a cooking mode, although both modes utilize the heat source.

According to this embodiment, the control unit 50 determines if a start signal is received (S3). Once the start signal is received, the control unit 50 determines if a temperature, detected by the temperature detecting unit 52, is equal to or greater than a first reference temperature T1 (S4). In this embodiment, the first reference temperature T1 is a temperature that is useful for cleaning of the inside of the cavity 11, by, for example, wiping the surfaces of the cavity 11 with a cloth. For example, the first reference temperature may be 50° C. The first reference temperature may also be a temperature that is safe for a user, that is, safe for a user to wipe the porcelain enamel coating layer 12 of the cavity 11 with a cloth.

When the detected temperature is equal to or greater than the first reference temperature T1, the user can clean the inside of the cavity 11 without further heating of the cavity 11. Therefore, when the detected temperature is equal to or greater than the first reference temperature T1, the control unit 50 causes the informing unit 35 to generate a signal showing, for example, that the cavity is ready to be cleaned (S21).

On the other hand, if the detected temperature is less than the first reference temperature T1, the control unit 50 determines if the selected mode is the first mode (S5).

If the selected mode is the first mode, the control unit 50 may turn on the heat source in accordance with an operation condition of the first mode (S6). Further, when the heat source starts operating, a timer 54 may operate to count a predetermined amount of time before the heat source is turned off.

For example, at least one of the upper, lower and convection heaters may continuously operate or may be repeatedly turned on and off during operation according to the first (or any) mode. In addition, when the convection heater operates, the convection fan may operate therewith.

When the heat source operates, the internal temperature of the cavity 11 may increase as shown in FIG. 4.

During operation of the heat source, the control unit 50 may determine if the temperature detected by the temperature detecting unit meets or exceeds the first reference temperature T1 (S7). Such an operation S7 may be for determining if the heat source should be turned off.

In the exemplary embodiment, if the detected temperature reaches the first reference temperature T1, the control unit 50 may execute commands to turn off the heat source (S8).

Further, the control unit 50 may determine if the time, as measured by the timer 54 from the start of the operation, reaches a first reference time t1 (S9). The first reference time t1 may be, for example, 5 minutes as described above.

At this point, even if the heat source is turned off, the internal temperature of the cavity may still increase due to the heat remaining on the heat source. However, if the heater is turned off, for example, when the temperature detector detects the internal temperature is at or has exceeds the first temperature T1, the rise of the temperature in the cavity 11 after termination of the heater's operation S8 will not significantly increase beyond the first reference temperature T1. Thus, the safety of a user can be maintained.

In the exemplary embodiment, when the measured time reaches the first reference time t1, the control unit 50 may cause the informing unit 35 to generate a signal to show that the reference time t1 was reached (S21). A reason for generating the signal, to show the expiration of the reference time t1, may be to alert or remind the user to begin wiping the interior of the cavity 11 before the water therein is fully vaporized.

Meanwhile, if it is determined at S5 that the first mode is not selected, it is determined if the second mode is selected (S10). If the second mode is selected, the control unit 50 operates the heat source in accordance with the operational condition of the second mode (S11). Further, when the heat source starts operating, the timer 54 operates to measure the length of time since the heater was turned on.

When the heat source operates in the second mode, the internal temperature of the cavity 11 may increase as shown in FIG. 5. During operation of the heat source, the control unit 50 may determine if the temperature detected by the temperature detecting unit reaches the second reference temperature T2 (S12). The second reference temperature T2 may be the same as or different from the first reference temperature T1.

If at S12 it is determined that the temperature of the cavity 11 is equal to or greater than the second reference temperature T2, the control unit 50 may stop operation of the heat source (S13). That is, the heat source may be turned off.

When a predetermined time dt1 has passed after the heat source stops operating, the control unit 50 may operate the heat source to maintain the internal temperature of the cavity 11 at the second reference temperature T2 (S14).

In more detail, when the heat source stops operating, the internal temperature of the cavity 11 initially increases by the heat remaining on the heat source, but then the internal temperature of the cavity 11 will begin to decrease.

In order to maintain the internal temperature of the cavity at the second reference temperature T2, the control unit 50 may control at least one of the upper 16, lower 18, and convection heater 42 and convection fan 44 to repeatedly turn on and off. As will be understood, when the convection heater 42 operates, the convection fan 44 may also operate.

Next, the control unit 50 determines if the time detected by the timer 54 reaches a second reference time t2 (S15). The second reference time t2 may be 20 minutes as described above.

When the measured time reaches the second reference time t2, the control unit 50 controls the informing unit 35 to generate a signal showing the time to begin cleaning the interior surfaces of the cavity 11 has been reached (S21). Cleaning may be accomplished by wiping the interior surfaces of the cavity 11. As before, a reason for generating the signal, to show the expiration of the reference time t2, may be to alert or remind the user to begin wiping the interior of the cavity 11 before the water therein is fully vaporized.

Meanwhile, when it is determined in the operation S10 that the second mode is not selected, the control unit 50 operates the heat source under a preset operation condition of the third mode (S16). When the heat source starts operating, the timer 54 operates to count the time under the third mode.

When the heat source operates, the internal temperature of the cavity 11 may increase as shown in FIG. 6. During operation of the heat source, the control unit 50 determines if a temperature detected by the temperature detecting unit 52 reaches a third reference temperature T3 (S17). Here, the third reference temperature T3 may be, for example, 100° C.

If the detected temperature reaches the third reference temperature T3, the control unit 50 may stop the operation of the heat source (S18).

Next, the control unit 50 may operate the convection fan 44, if present in the cooking appliance 1, to reduce the internal temperature of the cavity 11. The convection fan 44, if present, may operate continuously, or be repeatedly turned on and off.

Next, the control unit 50 determines if the time detected by the timer 54 reaches a third reference time t3 (S20). The third reference time t3 may be, for example, 30 minutes as described above.

When the measured time reaches the third reference time t3, the control unit 50 controls the informing unit 35 to generate a signal showing the time to begin cleaning the interior surfaces of the cavity 11 has been reached (S21). Cleaning may be accomplished by wiping the interior surfaces of the cavity 11. As before, a reason for generating the signal, to show the expiration of the reference time t3, may be to alert or remind the user to begin wiping the interior of the cavity 11 before the water therein is fully vaporized.

At this point, the internal temperature of the cavity 11, when the signal showing that the time to begin cleaning the interior surfaces of the cavity 11 (e.g., the optimal cleaning time) has been reached, the internal temperature of the cavity 11 may be the same as the first reference temperature T1.

As described above, the heat source stops operating when the detected temperature reaches the reference temperature under each mode. In addition, when the timer 54 reaches the preset time established for each cleaning mode, the control unit 50 controls the informing unit 35 to generate a signal showing that the time to begin cleaning the interior surfaces of the cavity 11 has been reached (S21).

That is, there is a time delay from a point where the internal temperature of the cavity reaches the reference temperature to a point where the signal showing that the time to begin cleaning the interior surfaces of the cavity 11 has been reached (S21). The reason for this time delay may be to allow the water in the cavity 11 to be soaked into the polluting material in the cavity 11. For this reason, the time delay may be referred to as a soaking time.

According to the embodiment described herein, a state where the inside of the cavity can be easily cleaned can be maintained for a period of time. Additionally, a user can be informed, via the informing unit 35, that the time to begin cleaning (e.g., by wiping) has arrived. Therefore, the cavity 11 can be easily cleaned.

Figure 7:
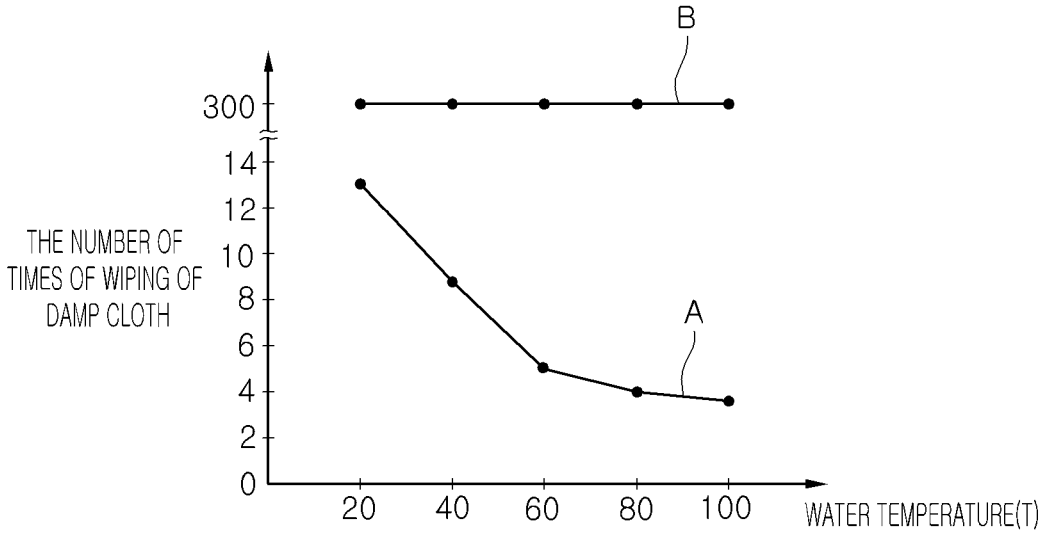
FIG. 7 is a graph illustrating a measure of cleaning performance versus water temperature as a function of a normal porcelain enamel and a porcelain enamel containing a phosphate-based ingredient, according to an embodiment of the invention.

FIG. 7 is a graph illustrating a measure of cleaning performance versus water temperature as a function of a normal porcelain enamel and a porcelain enamel containing a phosphate-based ingredient, according to an embodiment of the invention. FIG. is a graph illustrating a measure of cleaning performance versus soaking time as a function of a normal porcelain enamel and a porcelain enamel containing a phosphate-based ingredient, according to an embodiment of the invention.

Figure 8:
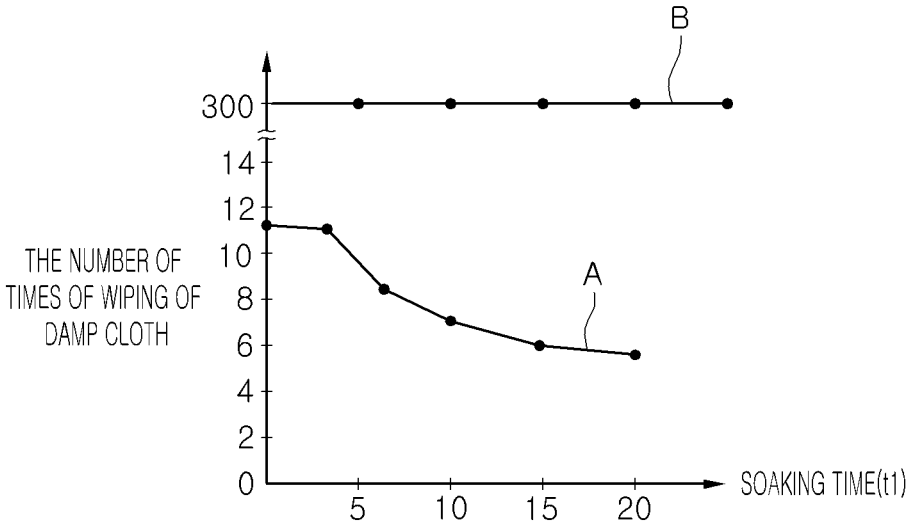
FIG. 8 is a graph illustrating a measure of cleaning performance versus soaking time as a function of a normal porcelain enamel and a porcelain enamel containing a phosphate-based ingredient, according to an embodiment of the invention.

FIGS. 7 and 8 illustrate test results when a chicken is cooked for 1.5 hour at an internal cavity 11 temperature of 230° C. using the convection heater 42 and convection fan 44. In addition, in FIG. 7, the soaking time is 3 minutes. In FIG. 8, a water temperature (a cavity temperature) is 20° C.

Referring to FIG. 7, for a normal porcelain enamel (B), the polluting materials are not fully removed regardless of the temperature even when the user wipes with a damp cloth 300 times. For a porcelain enamel (A) containing the phosphate-based ingredient, it can be noted that the number of times of wiping with a damp cloth is reduced as the water temperature increases.

Referring to FIG. 8, for the normal porcelain enamel (B), the polluting materials are not fully removed regardless of the soaking time even when the user wipes with a damp cloth 300 times. For the porcelain enamel (A) containing the phosphate-based ingredient, it can be noted that the number of times of wiping with the damp cloth is reduced as the soaking time increases.

Therefore, in this embodiment, when the porcelain enamel (A), containing the phosphate-based ingredient, is applied to the cavity, the cleaning performance can be enhanced.

Figure 9:
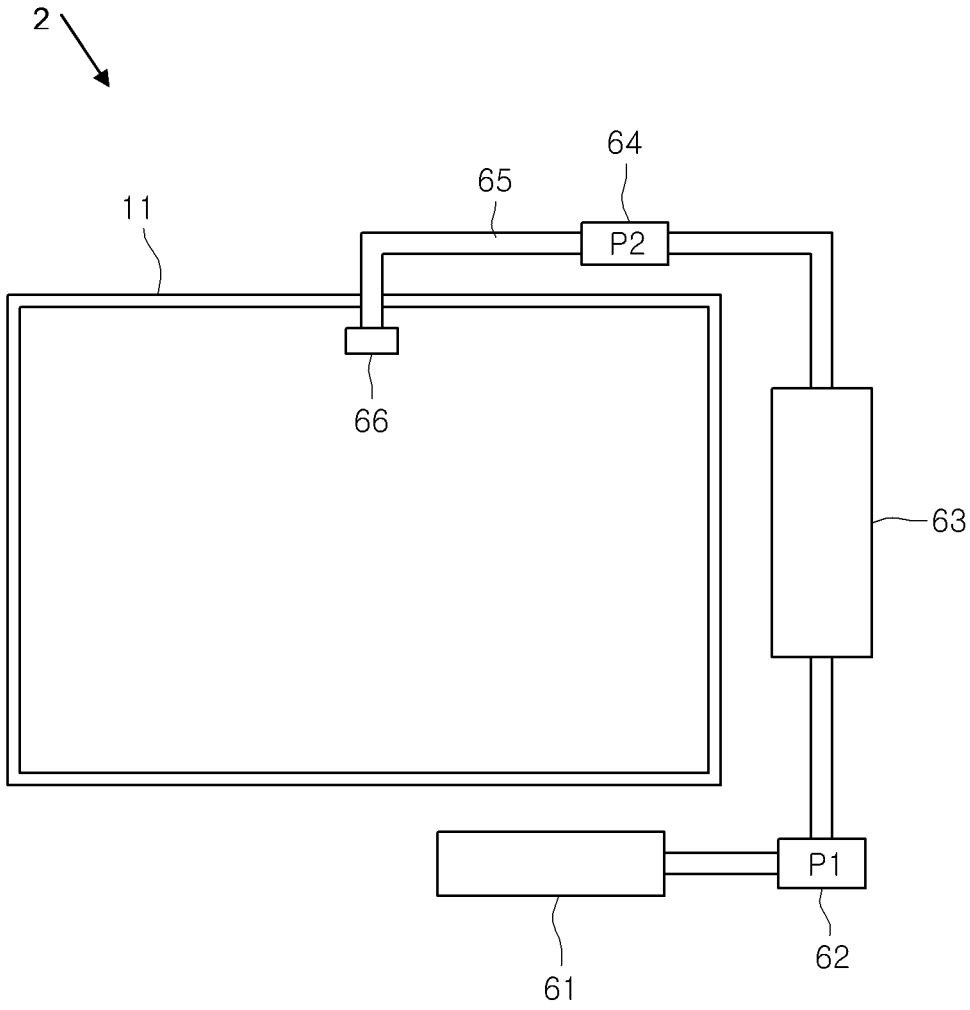
FIG. 9 is a schematic view of a cooking appliance according to a second embodiment of the invention.
Figure 10:
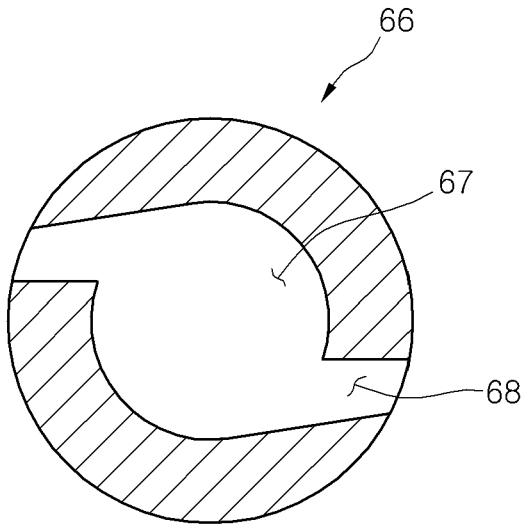
FIG. 10 is a sectional view of a nozzle of FIG. 9.

FIG. 9 is a schematic view of a cooking appliance 2 according to a second embodiment. FIG. 10 is a sectional view of a nozzle 66 of FIG. 9. The second embodiment is same as the first embodiment except that water for cleaning is automatically supplied into the cavity 11. Therefore, only unique features of the second embodiment will be described herein. In addition, like reference numbers will be used to refer to like parts.

In FIG. 9, the cooking appliance 2 is illustrated without upper or lower heaters or convection heater and convection fan, for ease of illustration. Referring to FIGS. 9 and 10, a cooking appliance 2 includes a cavity 11 defining a cooking chamber, a water tank 61 storing water to be supplied to the cavity 11 therein, a heating unit 63 for heating the water supplied from the water tank 61, a nozzle 66 for supplying the water heated in the heating unit 63 into the cavity 11, a first pump 62 for supplying the water stored in the water tank 61 to the heating unit 63, and a second pump 64 for supplying the water heated in the heating unit 63 to the nozzle 66.

The water tank 61, first pump 62, heating unit 63, second pump 64, and nozzle 66 define a water supplying unit for automatically supplying the water into the cavity 11. Although not shown in the drawings, the water tank 61 may be connected to a water supply pipe, or the water tank 61 can be detachably coupled to the cooking appliance 2 so that it can be filled from a remote source of water, such as a kitchen faucet.

The nozzle 66 may be located at an inner-upper side of the cavity to evenly distribute the water into the cavity 11. The nozzle 66 may be exposed to the inside of the cavity 11. Further, the nozzle 66 may be rotatably coupled to a pipe 65 connected to the second pump 64. The invention is not limited to the configuration illustrated in the embodiment of FIG. 9.

With reference to FIG. 10, the nozzle 66 may be provided at an inside of the cavity 11 with a space 67 into which the water is introduced and a plurality of discharge holes 68 for discharging the water. In this embodiment, the discharge holes 68 extend from the outer edges of the space 67 along a line that is tangent to the outer edges of the space 67. Therefore, in this embodiment, when the nozzle 66 is rotatably mounted to the pipe 65 (FIG. 9) the nozzle 66 may rotate by reaction to the force of water spraying from the discharge holes 68.

Figure 11:
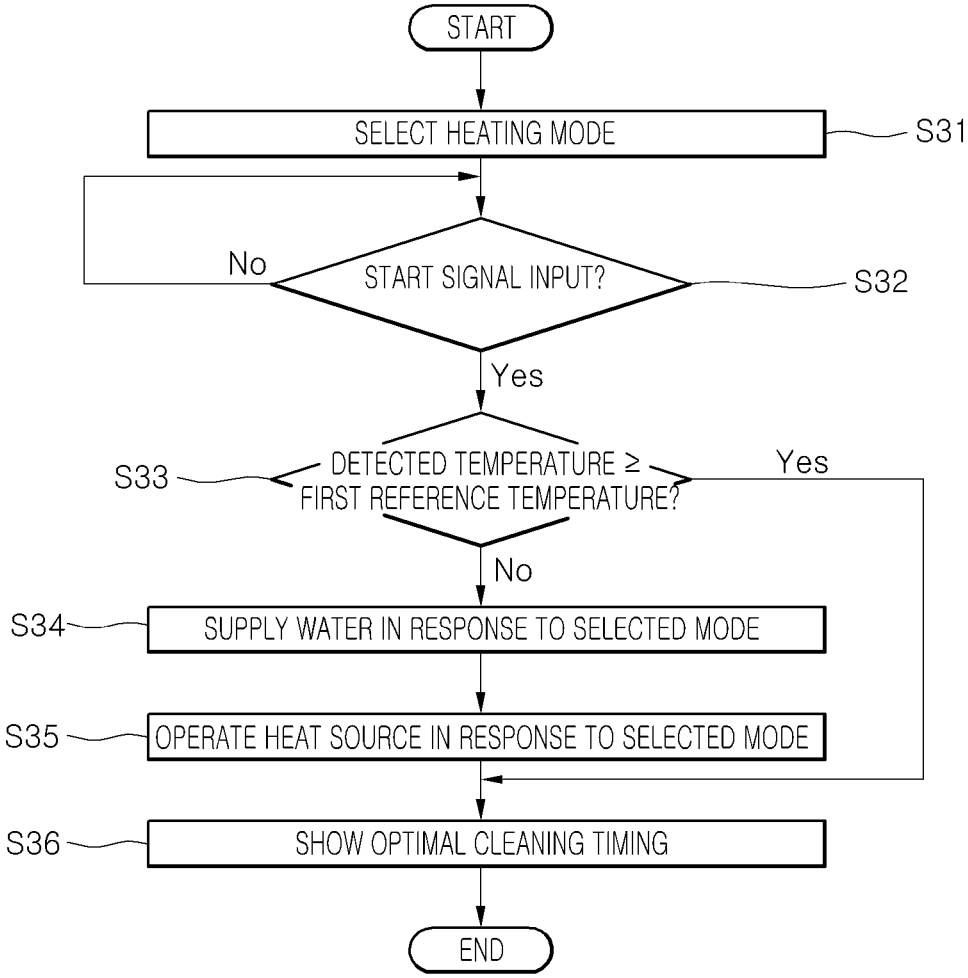
FIG. 11 is a flowchart illustrating a control method of a cooking appliance, according to a second embodiment of the invention.

FIG. 11 is a flowchart illustrating a control method of a cooking appliance according to a second embodiment of the invention. Referring to FIG. 11, a heating mode is selected by use of the selection unit 32 (S31). Next, the control unit 50 determines if a start signal is received (S32).

When the start signal is received, the control unit 50 determines if a temperature detected by the temperature detecting unit 52 is equal to or greater than a first reference temperature T1 (S33).

If the detected temperature is equal to or greater than the first reference temperature T1, the process goes to operation S36, because there is no need to further heat the cavity 11. That is, the informing unit 35 generates a signal showing that the time to clean the surfaces of the cavity 11 has been reached (S36).

On the other hand, if the detected temperature is less than the first reference temperature T1, the control unit 50 automatically supplies the water into the cavity 11 in response to the selected mode (S34).

At this point, amounts of the water supplied in the respective cleaning modes may be differently set. That is, an amount of the water supplied in the third mode where the level of the pollution is high may be greater than an amount of the water supplied in the first mode. An amount of the water supplied in the second mode may be less than the third mode but greater than the first mode.

Further, the control unit 50 controls such that the heat source operates in response to the selected mode (S35). Further, when the cleaning timing reaches the optical cleaning timing, the control unit 50 controls such that the informing unit generates a signal showing the optimal cleaning timing (S36). At this point, because the operation of the heat source and optimal times to begin cleaning in response to the selected mode are the same as in the first embodiment, the detailed descriptions thereof will be omitted.

Accordingly, once the signal informing the user that the time to begin cleaning the inner surfaces of the cavity 11 has been generated, the user can begin cleaning the inner surfaces of the cavity 11.

According to this embodiment, because the water is automatically supplied into the cavity 11, the user's convenience can be enhanced. Although the water is automatically supplied into the cavity in response to the selected mode in this embodiment, the present invention is not limited to this. That is, a water supplying button (not shown) may be additionally provided to the selection unit 32. If provided, the user can adjust an amount of the water supplied to the cavity 11. For example, the amount of the water supplied may be varied in accordance with the number of times a user presses the water supplying button. When the water supplying button is selected, the water supply is automatic in view of the water supplying aspect into the cavity but manual in view of the user's selection of the water supplying button. That is, in this embodiment, it can be understood that the water is manually supplied into the cavity. Of course, a preset amount of water could also be automatically provided to the cavity 11 in response to a selection of a cleaning mode.

Figure 12:
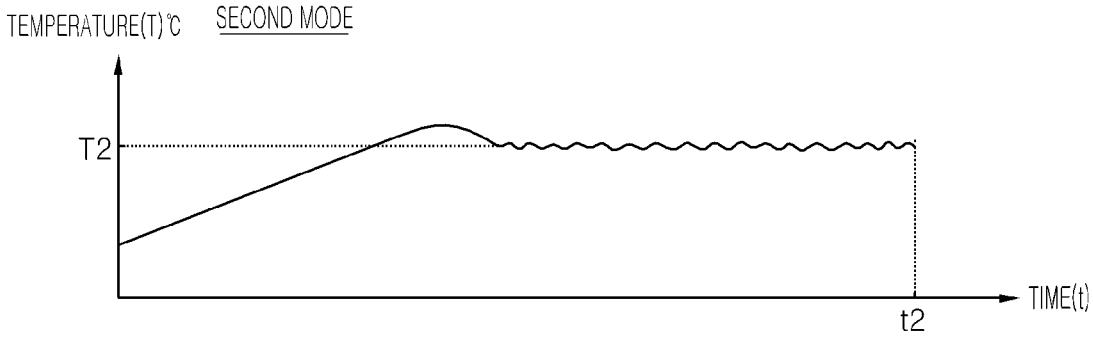
FIG. 12 is a graph illustrating a temperature variation versus time in a second mode, according to a third embodiment of the invention.

FIG. 12 is a graph illustrating a temperature variation versus time in a second mode, according to a third embodiment of the invention. The third embodiment is identical to the first embodiment except for a method for determining restart timing after the heat source stops operating. Therefore, only the features of this embodiment will be described in this embodiment.

Referring to FIGS. 3 and 12, when the second mode is selected, the control unit operates the heat source in accordance with the operation condition of the second mode. When the heat source operates, the internal temperature of the cavity 11 may increase as shown in FIG. 12.

During the operation of the heat source, the control unit 50 determines if a temperature detected by the temperature detecting unit 52 reaches a second reference temperature T2. When the detected temperature reaches the second reference temperature T2, the control unit 50 stops the operation of the heat source.

When the heat source stops operating, the internal temperature of the cavity 11 will eventually reduce as time passes. At this point, the control unit 50 determines if the internal temperature of the cavity 11 reaches the second reference temperature T2.

If the internal temperature of the cavity 11 reaches the second reference temperature T2, the control unit 50 controls the operation of the heat source such that the internal temperature of the cavity 11 is maintained at the second reference temperature T2. That is, at least one of the upper, lower, and convection heater and fan are controlled to be repeatedly turned on and off.

Next, the control unit 50 determines if a time detected by the timer 54 reaches a second reference time t2. When the time reaches the second reference time t2, the control unit 50 controls such that the informing unit 35 generates a signal showing the optimal cleaning timing.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings, and the appended claims. In addition to variations and modifications in the component parts and/or arrangements, alternative uses will also be apparent to those skilled in the art.

What is claimed is:

1. A cooking appliance comprising:

a heat source;

an input unit configured to input a plurality of operational modes of the heat source, wherein the plurality of operational modes is a plurality of cleaning modes for cleaning a cavity of the cooking appliance;

a control unit configured to operate the heat source in accordance with a selected cleaning mode input through the input unit;

a memory that stores operational conditions of the heat source and reference times for the respective cleaning modes; and an informing unit showing a time according to the selected cleaning mode;

wherein the input unit comprises a selection unit configured to permit a user to select one of the plurality of cleaning modes, wherein when the cleaning mode is selected, the heat source is operated, wherein the control unit stops the operation of the heat source when an operational time of the heat source reaches a predefined operation stop time, wherein the control unit determines whether a reference time corresponding to the selected cleaning mode has passed after stopping the operating of the heat source, wherein the control unit controls the informing unit to show a signal after determining that a reference time has passed after stopping the operating of the heat source, and wherein an amount of the reference times are different for each of the plurality of cleaning modes.

2. The cooking appliance according to claim 1, wherein the input unit further comprises a start button configured to start the selected cleaning mode.

3. The cooking appliance according to claim 1, wherein the specific cleaning mode of the plurality of cleaning modes is selected in accordance with the number of times of pressing of the selection unit or an amount of time the selection unit remains pressed.

4. The cooking appliance according to claim 1, wherein the selection unit comprises a plurality of selection buttons corresponding to the respective cleaning modes.

5. The cooking appliance according to claim 1, wherein a signal generated by the informing unit is a visual signal or an acoustic signal.

6. The cooking appliance according to claim 1, wherein the heat source heats water in the cavity to clean the cavity.

7. A cooking appliance comprising:

a cavity configured to define a cooking chamber;

a heat source configured to generate heat to clean the cavity;

an input unit configured to select between at least a first operational mode of the heat source to clean the cavity and second operational mode of the heat source to cook food in the cavity; and a control unit configured to control operation of the heat source in accordance with the first or second operational mode;

wherein a porcelain enamel coating layer comprising a phosphate-based ingredient is provided on an inner surface of the cavity.

8. The cooking appliance according to claim 7, wherein the phosphate-based ingredient is phosphorus pentoxide ($P_2O_5$).

9. The cooking appliance according to claim 7, further comprising an informing unit to show a cleaning time of the cavity or a cooking time of the cavity, in accordance with the first or second operational mode, respectively.

10. The cooking appliance according to claim 9, wherein the first operation mode of the heat source, for cleaning the cavity, comprises a plurality of operational modes, and wherein a time from a point where the heat source starts operating to a point where the informing unit generates a signal is different for each of the plurality of operational modes.

* * * * *